US006699822B2

(12) United States Patent
Bruner et al.

(10) Patent No.: US 6,699,822 B2
(45) Date of Patent: Mar. 2, 2004

(54) SULFATED DICARBOXYLIC ACIDS FOR LUBRICATION, EMULSIFICATION, AND CORROSION INHIBITION

(75) Inventors: Michael C. Bruner, Naperville, IL (US); Arnold Netzel, Chicago, IL (US); Phillip W. Hurd, Conyers, GA (US)

(73) Assignee: Georgia-Pacific Resin, Inc., Atlanta, GA (US)

( * ) Notice: Subject to any disclaimer, the term of this patent is extended or adjusted under 35 U.S.C. 154(b) by 28 days.

(21) Appl. No.: 10/163,630

(22) Filed: Jun. 7, 2002

(65) Prior Publication Data

US 2003/0232728 A1 Dec. 18, 2003

(51) Int. Cl.[7] ..... C10M 135/10; C23F 11/00

(52) U.S. Cl. ..... 508/222; 508/405; 508/410; 508/412; 508/452; 252/391; 252/395

(58) Field of Search ..... 508/222, 452, 508/410, 412; 252/391, 395

(56) References Cited

U.S. PATENT DOCUMENTS

| | | | | |
|---|---|---|---|---|
| 2,482,761 A | | 9/1949 | Goebel | |
| 2,631,979 A | | 3/1953 | McDermott | |
| 2,632,695 A | | 3/1953 | Landis | |
| 3,753,968 A | * | 8/1973 | Ward | 582/509 |
| 3,842,119 A | | 10/1974 | Bills | |
| 3,981,682 A | | 9/1976 | Ward | |
| 4,030,417 A | | 6/1977 | Lipovac | |
| 4,394,126 A | * | 7/1983 | Wilson | 8/115.6 |
| 4,476,055 A | | 10/1984 | Du Vernet | |
| 4,494,992 A | | 1/1985 | Schilling | |
| 4,514,335 A | | 4/1985 | Du Vernet | |
| 4,556,496 A | * | 12/1985 | Glova | 508/405 |
| 4,571,309 A | | 2/1986 | Lege | |
| 4,614,600 A | * | 9/1986 | Schilling et al. | 507/260 |
| 4,956,106 A | | 9/1990 | Woodward | |
| 5,008,039 A | | 4/1991 | Woodward | |
| 5,320,767 A | * | 6/1994 | Habeeb | 508/412 |

FOREIGN PATENT DOCUMENTS

EP 0295108 B1 7/1991

WO WO 97/30133 A1 8/1997

OTHER PUBLICATIONS

Declaration of Phillip Hurd.

* cited by examiner

*Primary Examiner*—Ellen M. McAvoy
(74) *Attorney, Agent, or Firm*—Banner & Witcoff, Ltd.

(57) ABSTRACT

Sulfated dicarboxylic acids, amine salts thereof, or inorganic salts thereof may be used in various applications, including use as corrosion-inhibiting additives (e.g., in oil-field drilling applications and in metalworking applications), as emulsifiers (e.g., in metalworking applications), and as lubricity-enhancing additives (e.g., in metalworking applications). Suitable sulfated dicarboxylic acids include sulfated cyclic dicarboxylic acids, as well as their amine salts or inorganic salts, according to the formula:

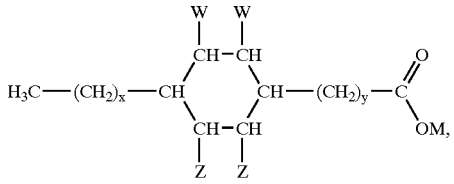

wherein:

(a) x and y each independently represents an integer from 3 to 9, wherein x and y together equal 12; (b) Z represents a moiety selected from the group consisting of hydrogen and COOM, wherein at least one Z is hydrogen and one Z is COOM; (c) W represents a moiety selected from the group consisting of hydrogen and —O—$SO_3$M, wherein at least one W represents —O—$SO_3$M; and (d) M represents a member selected from the group consisting of hydrogen, an inorganic ion, or an amine radical, wherein each M may be the same or different. In some examples, at least one M may constitute an alkanolamine radical, such as a triethanolamine radical, a diglycolamine radical, a monoethanolamine radical, and an isopropanolamine radical, or an alkali metal ion, such as sodium ions and/or potassium ions.

44 Claims, No Drawings

SULFATED DICARBOXYLIC ACIDS FOR LUBRICATION, EMULSIFICATION, AND CORROSION INHIBITION

FIELD OF THE INVENTION

The present invention relates to sulfated dicarboxylic acids, amine salts thereof, or inorganic salts thereof, their use as corrosion-inhibiting additives in oil-field drilling applications and in metalworking applications, their use as emulsifiers in metalworking applications, and their use as boundary lubricity additives in metalworking applications.

BACKGROUND

Liquid media present in various mechanical systems, such as hydrocarbon-containing liquids in internal combustion engines, pipelines, or storage tanks, may be very corrosive to metal parts that make up the systems. Additionally, because moisture or liquid water is almost always present as contamination from some source in such systems, rusting due to the presence of water can often pose a problem. Moreover, with changing temperatures over the course of a day, vapor present in a tank or pipeline may expand or contract. When it contracts, ambient air may be drawn into the tank or pipeline (and subsequently into any connected system, such as an engine), and any moisture contained in that air then may condense inside the tank, pipeline, or engine. A considerable volume of water may be introduced into a tank during an extended storage period, especially when located in a humid environment. Additional dangers potentially resulting from rusting during storage lie in the damage to costly equipment, contamination of the fuel due to the presence of particles of iron oxide (i.e., from the rust or corrosion) that may scale off the walls of a tank or pipeline, and contamination of the environment because of a leak resulting from the corrosion of the walls of a tank or pipeline. Thus, inhibiting corrosion or rusting of metal surfaces is an important factor in maintaining such systems in proper and efficient working condition, in assuring longevity of the systems, and in protecting the environment.

As is known, fatty acids, and in particular, polymerized fatty acids known as "dimer acids," may be used as corrosion inhibitors in numerous systems. Examples of dimer acids used as corrosion inhibitors are provided in U.S. Pat. No. 2,482,761 to Goebel, U.S. Pat. No. 2,631,979 to McKermott, and U.S. Pat. No. 2,632,695 to Landis. These patents discuss polymerized diunsaturated monocarboxylic acids, e.g., dilinoleic acid and the dimeric acids obtained by the distillation of castor oil in the presence of sodium hydroxide, as being particularly suitable. Other sources of dimeric acids include tall oil fatty acids, such as oleic or linoleic acids.

Various dicarboxylic acids also are known in the art for various applications. For example, U.S. Pat. No. 3,753,968 (to Ward) discloses the preparation of a $C_{21}$ dicarboxylic acid that may be used as a plasticizer or an epoxy curing agent. U.S. Pat. No. 3,842,119 (to Bills) describes a hydroxypropane sulfonated adduct of a soap of the dicarboxylic acid of Ward's '968 Patent. This adduct is used as a lime dispersant.

U.S. Pat. No. 3,981,682 to Ward describes another use of the dicarboxylic acid according to the '968 Patent. This patent describes the use of the dicarboxylic acid, an alkali metal salt thereof, a mono or bis-alkanolamide derivative thereof, or an alkali metal salt of the alkanolamide derivative as a corrosion inhibitor to inhibit rust formation on metallic surfaces contact by petroleum hydrocarbons and aqueous media.

The DuVernet patents, U.S. Pat. Nos. 4,476,055 and 4,514,335, describe hemi- and bis-isethionate products prepared by reacting an alkali metal, ammonium or substituted ammonium 2-hydroxyethane sulfonate with a $C_{21}$ dicarboxylic acid. DuVernet discloses the use of these products as detergents for cleaning clay-soiled fabrics and notes their use as surfactants.

U.S. Pat. No. 4,614,600 to Schilling describes using an adduct of a polyamine, such as a di- or tri-ethyleneamine, and the dicarboxylic acid of the '968 Patent, as an anticorrosive composition in well-drilling operations. Another Schilling patent, U.S. Pat. No. 4,494,992, describes amphoteric emulsifiers for making bituminous emulsions. The emulsifiers include a modified reaction product of a polycarboxylic acid.

The Woodward patents, U.S. Pat. Nos. 4,956,106 and 5,008,039, describe a low-foaming, rust-inhibiting composition including a blend of a dicarboxylic acid product according to the '968 Patent (as a rust inhibitor) and a vegetable oil adduct that is a triglyceride addition product with the dicarboxylic acid (as a foam inhibitor).

Lege, U.S. Pat. No. 4,571,309, describes emulsifiers prepared by reacting an ammonium or substituted ammonium methyl isethionate alcohol with a $C_{22}$-cycloaliphatic tricarboxylic acid.

Each of the above-identified patents is entirely incorporated herein by reference.

SUMMARY

In one aspect, this invention relates to certain sulfated cyclic dicarboxylic acids, their amine salts, and their inorganic salts. Compositions according to some examples of this invention may be obtainable by reacting sulfuric acid and at least one reactant selected from the group consisting of:

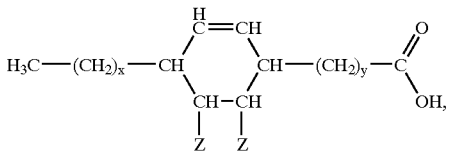

(a dicarboxylic acid)

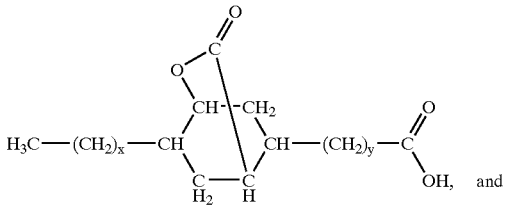

(a lactone)

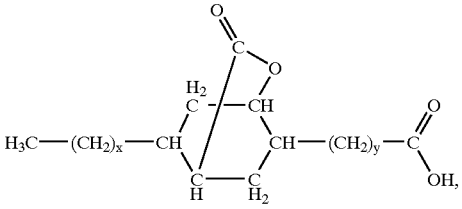

(a lactone)

wherein, in these formulae:

(a) x and y each independently represents an integer from 3 to 9, wherein x and y together equal 12, and (b) Z represents a moiety selected from the group consisting of hydrogen and COOH, wherein at least one Z is hydrogen and one Z is COOH. Any suitable source of sulfuric acid can be used in the reaction without departing from this invention.

In another aspect, this invention relates to sulfated cyclic dicarboxylic acids and amine salts and inorganic salts thereof according to the formula:

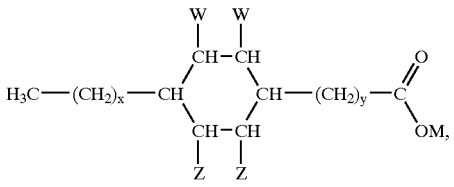

wherein:

(a) x and y each independently represents an integer from 3 to 9, wherein x and y together equal 12, (b) Z represents a moiety selected from the group consisting of hydrogen and COOM, wherein at least one Z is hydrogen and one Z is COOM, (c) W represents a member selected from the group consisting of hydrogen and —O—$SO_3M$, wherein at least one W represents —O—$SO_3M$, and (d) M represents a member selected from the group consisting of hydrogen, an inorganic ion, or an amine radical, wherein each M may be the same or different. The reaction between sulfuric acid and the cyclic dicarboxylic acid or lactone thereof as described in the preceding paragraph may result, at least in part, in a composition containing a sulfated cyclic dicarboxylic acid as illustrated in this formula.

While any suitable amine may be used to form an amine salt yielding an amine radical as substituent "M" without departing from this invention, one suitable class of amines includes alkanolamines, such as triethanolamines, diglycolamines, monoethanolamines, and isopropanolamines. Likewise, while any suitable inorganic base may be used to form an inorganic salt yielding an inorganic ion as substituent "M" without departing from this invention, one suitable class of inorganic bases includes the alkali metal hydroxides, such as lithium hydroxide, sodium hydroxide, and potassium hydroxide. Ammonium hydroxide also may be used as the inorganic base without departing from the invention.

Other aspects of this invention relate to the use of the sulfated cyclic dicarboxylic acid-containing compositions according to the invention as additives for inhibiting corrosion or enhancing lubricity of a material. As one example, the sulfated cyclic dicarboxylic acid (or its amine salt or its inorganic salt) may be used as an additive in hydrocarbon production, storage, and/or transport to inhibit corrosion of metal surfaces contacted by the hydrocarbon (such as a wall of a pipeline or a storage tank). When used as such, the additive may be present in the hydrocarbon in any suitable corrosion inhibiting amount, usually less than 5%, by weight, based on a total weight of the combined hydrocarbon and additive, and preferably in an amount of less than 3%, by weight, or even less than 1%, by weight. When used as a corrosion inhibitor, the corrosion-inhibiting additive and the corrosive material being treated may contact the metal surface (either independently or concurrently), and the corrosion-inhibiting additive will inhibit corrosion or rusting of the metal surface. When used as a lubricity-enhancing additive, the additive may be combined with a product material being produced, stored, or transported in a lubricity-enhancing amount, and it serves to lubricate surfaces or joints with which it comes in contact.

The additive according to some examples of the invention may be used in metalworking fluids, such as synthetic and semi-synthetic fluids. In such products, these additives can be used to replace or enhance the currently used co-emulsifiers (such as alkanolamines) and corrosion inhibitors (such as carboxylic acid amine salts). As another example, these additives can be used to replace or enhance the lubricants used in synthetic and semi-synthetic metalworking fluids, such as polyethylene glycol ethers. The additive may be present in any suitable or effective amount, for example, usually less than 5%, by weight, and, in some instances, in the range of 1 to 3% by weight. Those skilled in the art can readily determine appropriate and effective amounts of the additive through the use of routine experimentation.

Another aspect of the invention relates to methods for producing a sulfated cyclic dicarboxylic acid-containing composition and compositions containing amine or inorganic salts thereof. For example, sulfuric acid may be reacted with at least one reactant selected from the group consisting of:

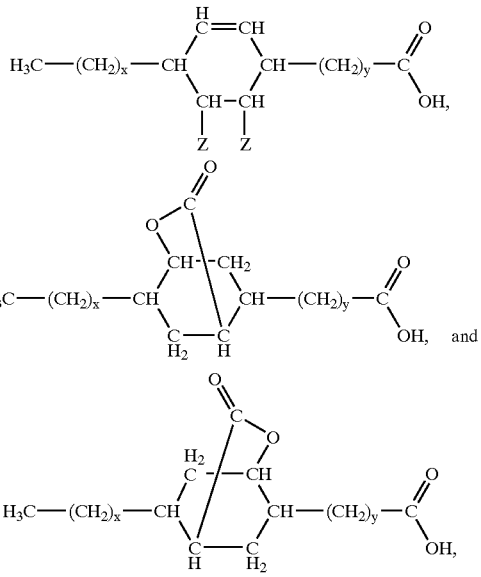

wherein, in these formulae:

(a) x and y each independently represents an integer from 3 to 9, wherein x and y together equal 12, and (b) Z represents a moiety selected from the group consisting of hydrogen and COOH, wherein at least one Z is hydrogen and one Z is COOH. This reaction forms desired sulfated cyclic dicarboxylic acid products. The sulfated dicarboxylic acid product may be further reacted, if desired, with an inorganic base (such as an alkali metal hydroxide) to produce an inorganic salt of the sulfated dicarboxylic acid product. Alternatively, the sulfated dicarboxylic acid product may be further reacted, if desired, with an amine (such as an alkanolamine) to produce an amine salt of the dicarboxylic acid product.

Present technology uses dimeric species as corrosion inhibitory and lubricant additives. These conventional additives generally are of a high molecular weight and are not water soluble, thereby requiring use of a solvent as a carrier. Additives in accordance with some preferred examples of the present invention are particularly advantageous because they are made from relatively low molecular weight raw materials that are biodegradable and both water and oil soluble. As a result, losses to the environment of such additives will have no significant impact due to their low toxicity and biodegradability.

These and other advantageous aspects of the invention will become apparent to the skilled artisan from the following detailed description and specific examples of the invention.

DETAILED DESCRIPTION

Protecting metal surfaces from rust and corrosion is an important factor in many fields of technology. One manner of providing such protection is through use of corrosion-inhibiting additives that form a thin protective film on a metal surface, which film resists attack by corrosive agents in the fluid. Examples of corrosive fluids that may be treated using additives and methods according to this invention include hydrocarbon-containing fluids and gases containing water, such as crude petroleum as it comes from the well; petroleum distillates, such as fuel oil, diesel oil, kerosene, gasoline, and aviation fuel; and mixture of petroleum hydrocarbons and brine.

The present invention generally relates to environmentally friendly lubrication and corrosion-inhibiting additives. These additives may be used in any suitable environment, for example, in crude oil drilling and recovery operations and in the subsequent shipment of crude oil through pipelines. Additives according to some examples of the invention may be used, for example, in metalworking fluids, such as synthetic and semi-synthetic fluids. In such products, these additives can be used to replace or enhance the currently used co-emulsifiers (such as alkanolamines) and corrosion inhibitors (such as carboxylic acid amine salts). As another example, the additives according to examples of the invention may be used to replace or enhance the lubricants used in synthetic and semi-synthetic metalworking fluids, such as polyethylene glycol ethers.

Lubrication and corrosion-inhibiting additives according to this invention may be comprised of a sulfated dicarboxylic acid, an amine salt thereof, or an inorganic salt thereof. In one example of the invention, the sulfated dicarboxylic acid may be a sulfated cyclic dicarboxylic acid, an amine salt thereof, or an inorganic salt thereof, prepared by reacting a cyclic dicarboxylic acid and/or an associated lactone thereof with sulfuric acid. Suitable dicarboxylic acids useful as staring materials include cyclic dicarboxylic acids of the type described, for example, in U.S. Pat. Nos. 3,753,968 and 3,981,682. One particularly suitable dicarboxylic acid starting material for use in this invention is a $C_{21}$ dicarboxylic acid material known as DIACID 1550, commercially available from Westvaco. This commercially available dicarboxylic acid is also believed to contain a significant amount of the corresponding lactones and monomers (e.g., 11–18%, by weight, based on a total weight of the DIACID 1550 product). As used in this specification and in this context, the term "monomer" refers to residual unreacted fatty acids that may be present in commercially available DIACID 1550 dicarboxylic acid starting material, e.g., as a result of incomplete reaction of the fatty acids used in preparing DIACID 1550 or incomplete separation of DIACID 1550 from its starting materials.

In accordance with one example of the invention, a dicarboxylic acid starting material and/or a lactone thereof (such as DIACID 1550, which is believed to contain the dicarboxylic acid, its lactones, and monomers thereof) is sulfated by reacting it with sulfuric acid (e.g., concentrated sulfuric acid), under suitable reaction conditions, to form a sulfated dicarboxylic acid product. One of the reactions taking place as a result of this procedure is illustrated below:

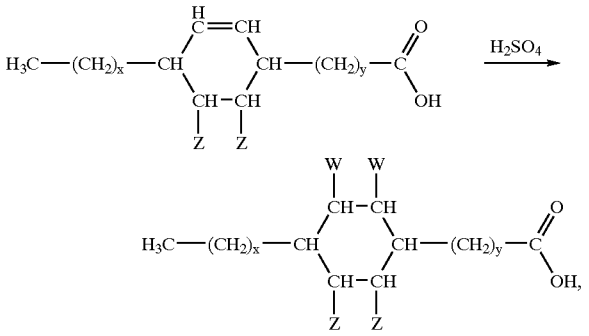

wherein:

(a) x and y each independently represents an integer from 3 to 9, wherein x and y together equal 12, (b) Z represents a moiety selected from the group consisting of hydrogen and COOH, wherein at least one Z is hydrogen and one Z is COOH, and (c) W represents a moiety selected from the group consisting of hydrogen and —O—$SO_3H$, wherein at least one W represents —O—$SO_3H$. Alternatively, or additionally, the starting material for the reaction may include one or both of the following lactones, which likewise react with sulfuric acid to form sulfated dicarboxylic acids identified in the reaction scheme above:

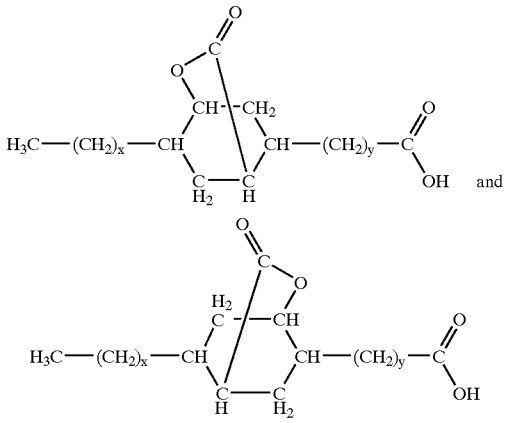

In these formulae, the variables have the same definitions as those provided above.

While any suitable and effective amount of sulfuric acid can be used in these reactions without departing from the invention, in some preferred examples of invention, the sulfuric acid is added in molar excess, and in some instances in substantial molar excess in order to sulfate the starting material to the greatest extent possible. As examples, the molar ratio of sulfuric acid to lactones present in the starting material may be in the range of 2:1 or higher, and in some inches 4:1 or higher.

The sulfated dicarboxylic acids then may be further modified, e.g., by reacting with an amine or an inorganic base to make a corresponding amine salt or inorganic metal salt. This further reaction may change the "M" substituent in the formula above from hydrogen to another appropriate substituent group, such as an inorganic ion or an amine radical. Any suitable amine or inorganic base may be used without departing from the invention. For example, suitable amines may include alkanolamines, such as triethanolamine ("TEA"), diglycolamine ("DGA"), monoethanolamine ("MEA"), isopropanolamines (e.g., monoisopropanolamine, diisopropanolamine, etc.), and the like (in these examples, at least some of the substituents "M" from the above formula will become a triethanolamine radical, a diglycolamine radical, a monoethanolamine radical, an isopropanolamine radical, or the like). Examples of suitable inorganic bases include bases of the alkali metals, such as lithium, sodium, potassium, and the like (e.g., introduced into the reaction in the form of aqueous solutions of lithium hydroxide, sodium hydroxide, potassium hydroxide, or the like). In these examples, at least some of the substituents "M" from the above formula will become an inorganic ion, such as a lithium ion, a sodium ion, or a potassium ion.

Any suitable and effective amount of amine base or inorganic base may be used without departing from the invention. As one example, sufficient base is added to convert the sulfated dicarboxylic acid to its corresponding amine salt or inorganic salt (e.g., a 1:1 molar ratio of amine base or inorganic base to the sulfate present in the sulfated dicarboxylic acid product). An excess of the amine base or inorganic base may be used, e.g., to maximize the salt production. Those skilled in the art can determine appropriate amounts of base for a given product through the use of routine experimentation.

Of course, other suitable ingredients may be included to produce a fully formulated additive composition (depending on the ultimate use) without departing from the invention, such as additional materials to further enhance or supplement the desired corrosion resistance and/or lubricant properties of the additive. Additional ingredients may be added to provide and/or enhance other desired properties of the additive composition.

While one potential starting material, namely DIACID 1550 (including the dicarboxylic acid itself as well as its lactones and monomers), is commercially available from Westvaco, as described above, other suitable starting materials for use in the present invention also may be prepared by reacting linoleic acid (obtained from tall oil) with acrylic acid in the presence of an iodine catalyst. The resulting reaction product includes $C_{21}$ dicarboxylic acids characterized by a cyclohexene moiety. Although not wishing to be bound by any specific theory or mechanism of operation, when sulfated in accordance with various examples of the present invention, sulfation of this dicarboxylic acid appears to occur at the site of unsaturation on the cyclic cyclohexene moiety. Additionally, and again while not wishing to be bound by any specific theory or mechanism of operation, when reacting with the corresponding lactones present in the dicarboxylic acid starting materials, sulfation of the lactone appears to break the lactone ring structure, thereby producing the dicarboxylic acid having one carboxylic acid moiety and a sulfate moiety on the cyclohexane ring structure. Suitable reaction conditions and examples for producing starting materials for use in the present invention are described, for example, in U.S. Pat. No. 3,753,968.

The following examples describe specific processes of making sulfated dicarboxylic acid and salt compositions according to examples of the invention. These specific disclosed processes merely exemplify the present invention, and they should not be construed as limiting the invention.

EXAMPLES 320 grams of DIACID 1550 were cooled down to 60° F. Concentrated sulfuric acid (55 grams) and the DIACID 1550 were mixed together at a rate such that at the end of the sulfuric acid addition the temperature of the mixture would be about 80° F. (in one specific example of this process, the maximum temperature reached was 78° F.). Optionally, external cooling also may be used to prevent excessive temperature increase.

A few minutes after all the acid was blended, the initial $SO_3$ content of the mixture was measured. No $SO_3$ content was found in the initial measurement. After forty-five minutes, another $SO_3$ content measurement was taken, and the $SO_3$ content was found to be 2.06% (by weight, based on the weight of the reaction mixture). This reaction mixture also is called the "acid oil" in this specification. Another fifteen minutes later, the acid oil was added to 125 grams of tap water. The high temperature resulting from the addition of acidic DIACID 1550 was about 110° F. Again, if desired, external cooling may be used to reduce or minimize the temperature rise.

Thereafter, in one example, the residual sulfuric acid was neutralized with 197 grams sodium hydroxide (in a 23% NaOH aqueous solution). This caused the resulting mixture to become cloudy and hazy, and the additional water from the NaOH addition caused the viscosity of the mixture to increase. At this time, sufficient sodium hydroxide was added to neutralize the excess sulfuric acid in the reaction mixture. Conversion of the sulfated dicarboxylic acid to its corresponding salt was not desired at this time.

The mixture was allowed to separate overnight into an acidic water phase and an acidic oil phase. The next day, 316 grams (approx. 270 mL) of acidic water was drawn off, and 357 grams (approx. 380 mL) of acidic oil (containing the sulfated DIACID 1550) was recovered. The pH of a 10% solution of the sulfated DIACID 1550 was measured at 4.83. The acid number of the resulting sulfated DIACID 1550 was determined to be 219.8, and its moisture content was determined to be 8.2% (by weight).

In another example, the sulfated DIACID 1550 acid oil material was further treated with triethanolamine in order to convert the dicarboxylic acid to its corresponding triethanolamine salt. In this example, 20 grams of triethanolamine and 35 grams of water were added to 357 grams of a sulfated DIACID 1550 material prepared as described above. The resulting mixture remained clear. The moisture content of this material was 17.71% (by weight), the pH of a 10% solution was determined to be 6.35 (a 5% solution had a pH of 6.3), and the specific gravity (77° F.) was determined to be 1.0534.

Other alkanolamine or inorganic salts can be produced in any suitable manner, such as in the general manner described above, without departing from the invention.

The following Table 1 describes various physical properties of examples of sulfated DIACID 1550, its sodium salt, its triethanolamine salt, its diglycolamine salt, and its monoethanolamine salt, produced according to the invention. Unless otherwise specified, all percentages are percentages by weight, based on a total weight of the solution, composition, or mixture being measured.

TABLE 1

| | Sulfated DIACID 1550 | Na Salt | TEA Salt | DGA Salt | MEA Salt |
|---|---|---|---|---|---|
| pH (10% in water.) | 3.96 | 4.43 | 5.0 | 4.93 | 4.49 |
| % Moisture | 6.81 | 7.43 | 4.29 | 4.92 | 4.72 |
| Acid Number | 217.9 | 216.0 | 231.3 | 236.2 | 240.4 |
| Specific Gravity (25° C.) | 1.03 | 1.04 | 1.04 | 1.04 | 1.04 |
| % $SO_3$ | 1.83 | 1.85 | 1.85 | 1.69 | 1.85 |

The specific examples described above include various ingredients in specified amounts. Of course, the relative amounts of the various ingredients can be varied substantially without departing from the invention. The following Table 2 describes the relative amounts of various ingredients that may be used in producing examples of sulfated DIACID 1550, its sodium salt, its potassium salt, its triethanolamine salt, its diglycolamine salt, and its monoethanolamine salt, according to the invention. These examples of compositions according to the invention can be produced, for example, in the manner described above. The percentages provided in Table 2 are percentages by weight, based on the entire weight of the complete reaction mixture, unless otherwise specified.

TABLE 2

| | Sulfated DIACID 1550 | Na Salt | K Salt | TEA Salt | DGA Salt | MEA Salt |
|---|---|---|---|---|---|---|
| DIACID 1550 | 25–55% | 46–66% | 40–60% | 38–58% | 40–60% | 46–66% |
| $H_2SO_4$[1] | 1–15% | 1–15% | 1–15% | 1–15% | 1–15% | 1–15% |
| Water | 10–25% | 12–32% | 10–30% | 10–30% | 10–30% | 12–32% |
| NaOH[2] | 15–35% | 1–20% | | | | |
| KOH[3] | | | 10–30% | | | |
| TEA | | | | 13–33% | | |
| DGA | | | | | 10–30% | |
| MEA | | | | | | 1–20% |

[1]May be added as an aqueous solution.
[2]May be added as an aqueous solution, e.g., a 23.5% NaOH solution, based on the total weight of the sodium hydroxide solution.
[3]May be added as an aqueous solution, e.g., a 45% KOH solution, based on the total weight of the potassium hydroxide solution.

Some or all of the water component may be added as an aqueous carrier of other ingredients, such as the sulfuric acid, the sodium hydroxide, and/or the potassium hydroxide.

Table 2 above provides general ranges of various ingredients. Preferred ranges of these same ingredients are provided in Table 3 below:

TABLE 3

| | Sulfated DIACID 1550 | Na Salt | K Salt | TEA Salt | DGA Salt | MEA Salt |
|---|---|---|---|---|---|---|
| DIACID 1550 | 42–52% | 51–61% | 45–55% | 43–53% | 45–55% | 51–61% |
| $H_2SO_4$[1] | 3–13% | 4–14% | 3–13% | 3–13% | 3–13% | 4–14% |
| Water | 13–23% | 17–27% | 14–24% | 14–24% | 14–24% | 17–27% |
| NaOH[2] | 20–30% | 6–16% | | | | |
| KOH[3] | | | 16–26% | | | |
| TEA | | | | 18–28% | | |
| DGA | | | | | 16–26% | |
| MEA | | | | | | 6–16% |

[1]May be added as an aqueous solution.
[2]May be added as an aqueous solution, e.g., a 23.5% NaOH solution, based on the total weight of the sodium hydroxide solution.
[3]May be added as an aqueous solution, e.g., a 45% KOH solution, based on the total weight of the potassium hydroxide solution.

The sulfated dicarboxylic acid material and/or its amine salts and/or inorganic salts according to the invention may be used as corrosion-inhibiting additives, lubricity-enhancing additives, and emulsifying agents, for example, in oil-field drilling or metalworking applications, in a conventional manner. As a more specific example, the sulfated materials according to some examples of the invention may be used as corrosion-inhibiting additives in petroleum hydrocarbons in the manner described in U.S. Pat. No. 3,981,682.

In use, the additives according to the invention also may be added to a pipeline, storage tank, or other application in any suitable amount without departing from the invention. For example, when used as a corrosion-inhibiting additive in a pipeline or storage tank, the additive may be metered into the pipeline and/or thoroughly mixed with the liquid to be transported in the pipeline (e.g., a hydrocarbon) in an effective amount, for example, in an amount of less than 1% by weight, and preferably in the range of 1 ppm to 400 ppm by weight, and possibly within the range of 50 to 300 ppm. Those skilled in the art can readily determine appropriate and effective amounts of the additives through the use of routine experimentation. When added as part of an aqueous (water-containing) layer, the corrosion-inhibiting additive according to the invention may be present in any suitable and effective amount, for example, in an amount of less than 1% by weight, and preferably in the range of 10 ppm to 400 ppm by weight, and possibly within the range of 25 ppm to 300 ppm.

As one example, products according to the invention may be used as part of a multi-component corrosion inhibition package. The corrosion-inhibiting performance of products according to some examples of the invention is better than that of conventional amine or phosphorus-containing corrosion inhibitors. In addition, reduced cost may be realized when treating fluids using the products according to examples of the invention because products according to examples of the invention may be used in reduced amounts as compared to conventional products.

In use, products according to the invention may be blended with other corrosion-inhibiting additives and solvents to make a formulated product, which may then be used in oil and gas production equipment such as pipelines, downhole tubing, and production vessels. The formulated product may be hard piped to many well heads, where it may be injected into the oil and produced water and gas coming out of the ground. The oil and water may be allowed to separate, and the additive product according to the invention will go either with the oil or water phase, depending on concentration effects. The water typically is re-injected back into the oil-bearing formation, where it again mixes with the oil or binds to the formation. The oil will enter the pipeline and eventually transport to an oil refinery or other suitable location for further processing.

While the invention has been described in terms of various specific examples, these specific examples merely exemplify the invention and do not limit it. Those skilled in the art will appreciate that changes and modifications may be made to these examples without departing from the spirit and scope of the invention.

We claim:

1. A composition obtainable by reacting sulfuric acid and at least one reactant selected from the group consisting of:

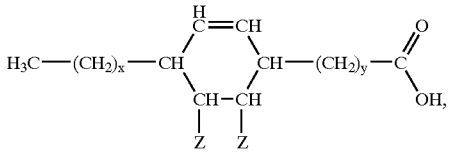

-continued

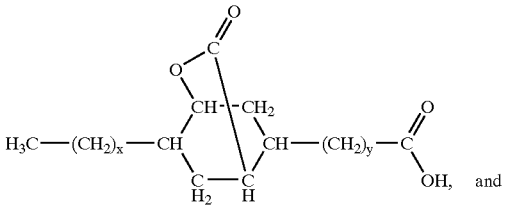

and

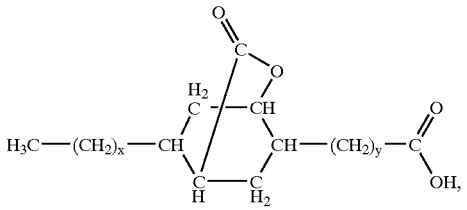

wherein, in these formulae:

x and y each independently represents an integer from 3 to 9, wherein x and y together equal 12; and Z represents a moiety selected from the group consisting of hydrogen and COOH, wherein at least one Z is hydrogen and one Z is COOH.

2. A composition comprising:

a compound according to the formula:

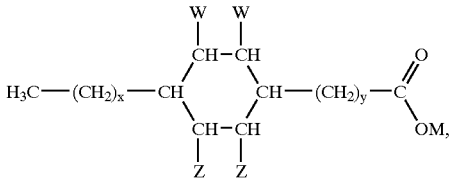

wherein:

x and y each independently represents an integer from 3 to 9, wherein x and y together equal 12;

Z represents a moiety selected from the group consisting of hydrogen and COOM, wherein at least one Z is hydrogen and one Z is COOM;

W represents a moiety selected from the group consisting of hydrogen and —O—$SO_3$M, wherein at least one W represents —O—$SO_3$M; and M represents a member selected from the group consisting of hydrogen, an inorganic ion, or an amine radical, and wherein each M may be the same or different.

3. A composition according to claim 2, wherein at least one M represents an amine radical.

4. A composition according to claim 3, wherein at least one M represents an alkanolamine radical.

5. A composition according to claim 3, wherein the amine radical is a member selected from the group consisting of: a triethanolamine radical, a diglycolamine radical, and a monoethanolamine radical.

6. A composition according to claim 2, wherein at least one M represents an inorganic ion.

7. A composition according to claim 6, wherein at least one M represents an alkali metal ion.

8. A composition according to claim 7, wherein at least one M represents a sodium ion or a potassium ion.

9. A composition, comprising:

a hydrocarbon; and an additive according to the formula:

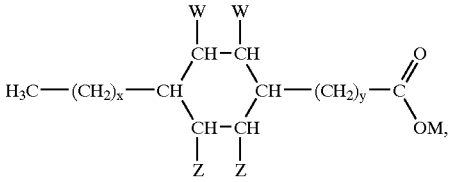

wherein:

x and y each independently represents an integer from 3 to 9, wherein x and y together equal 12, Z represents a moiety selected from the group consisting of hydrogen and COOM, wherein at least one Z is hydrogen and one Z is COOM, W represents a moiety selected from the group consisting of hydrogen and —O—$SO_3$M, wherein at least one W represents —O—$SO_3$M, and M represents a member selected from the group consisting of hydrogen, an inorganic ion, or an amine radical, and wherein each M may be the same or different.

10. A composition according to claim 9, wherein at least one M represents an amine radical.

11. A composition according to claim 10, wherein at least one M represents an alkanolanine radical.

12. A composition according to claim 10, wherein the amine radical is a member selected from the group consisting of: a triethanolamine radical, a diglycolamine radical, and a monoethanolamine radical.

13. A composition according to claim 9, wherein at least one M represents an inorganic ion.

14. A composition according to claim 13, wherein at least one M represents an alkali metal ion.

15. A composition according to claim 14, wherein at least one M represents a sodium ion or a potassium ion.

16. A composition according to claim 9, wherein the additive is present in an amount of less than 1%, by weight, based on a total weight of the composition.

17. A method for inhibiting corrosion on a metal surface, comprising: contacting a metal surface with a composition according to the formula:

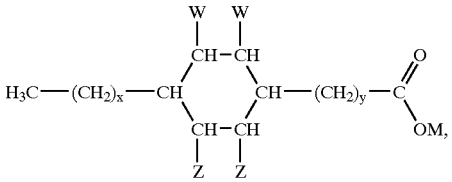

wherein:

x and y each independently represents an integer from 3 to 9, wherein x and y together equal 12, Z represents a moiety selected from the group consisting of hydrogen and COOM, wherein at least one Z is hydrogen and one Z is COOM, W represents a moiety selected from the group consisting of hydrogen and —O—$SO_3$M, wherein at least one W represents —O—$SO_3$M, and M represents a member selected from the group consisting of hydrogen, an inorganic ion, or an amine radical, wherein each M may be the same or different; and contacting the metal surface with a product material.

18. A method according to claim 17, wherein the composition and the product material are combined together prior to contacting the composition or the product material with the metal surface.

19. A method according to claim 17, wherein the metal surface includes a wall of a pipeline or a storage tank.

20. A method according to claim 19, wherein the composition and the product material are introduced separately into the pipeline or the storage tank.

21. A method according to claim 19, wherein the composition and the product material are introduced simultaneously into the pipeline or storage tank.

22. A method for inhibiting corrosion, comprising:

providing a product material, wherein the product material has corrosive properties; and combining a corrosion-inhibiting additive and the product material, wherein the corrosion-inhibiting additive includes a composition according to the formula:

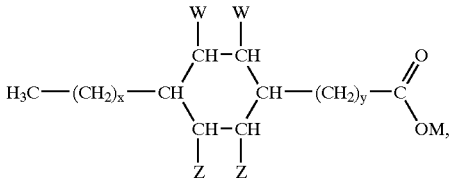

wherein:

x and y each independently represents an integer from 3 to 9, wherein x and y together equal 12, Z represents a moiety selected from the group consisting of hydrogen and COOM, wherein at least one Z is hydrogen and one Z is COOM, W represents a moiety selected from the group consisting of hydrogen and —O—$SO_3$M, wherein at least one W represents —O—$SO_3$M, and M represents a member selected from the group consisting of hydrogen, an inorganic ion, or an amine radical, wherein each M may be the same or different.

23. A method according to claim 22, wherein at least one M represents an amine radical.

24. A method according to claim 23, wherein at least one M represents an alkanolamine radical.

25. A method according to claim 23, wherein the amine radical is a member selected from the group consisting of: a triethanolamine radical, a diglycolamine radical, and a monoethanolamine radical.

26. A method according to claim 22, wherein at least one M represents an inorganic ion.

27. A method according to claim 26, wherein at least one M represents an alkali metal ion.

28. A method according to claim 27, wherein at least one M represents a sodium ion or a potassium ion.

29. A method according to claim 22, wherein the corrosion-inhibiting additive is present in an amount of less than 1%, by weight, based on a total weight of the combined corrosion-inhibiting additive and the product material.

30. A method for enhancing lubricity, comprising:

providing a carrier material; and combining a lubricity-enhancing additive and the carrier material, wherein the lubricity-enhancing additive includes a composition according to the formula:

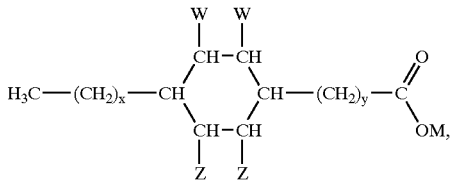

wherein:

x and y each independently represents an integer from 3 to 9, wherein x and y together equal 12, Z represents a moiety selected from the group consisting of hydrogen and COOM, wherein at least one Z is hydrogen and one Z is COOM, W represents a moiety selected from the group consisting of hydrogen and —O—$SO_3$M, wherein at least one W represents —O—$SO_3$M, and M represents a member selected from the group consisting of hydrogen, an inorganic ion, or an amine radical, wherein each M may be the same or different.

31. A method according to claim 30, wherein at least one M represents an amine radical.

32. A method according to claim 31, wherein at least one M represents an alkanolamine radical.

33. A method according to claim 31, wherein the amine radical is a member selected from the group consisting of: a triethanolamine radical, a diglycolamine radical, and a monoethanolamine radical.

34. A method according to claim 30, wherein at least one M represents an inorganic ion.

35. A method according to claim 34, wherein at least one M represents an alkali metal ion.

36. A method according to claim 35, wherein at least one M represents a sodium ion or a potassium ion.

37. A method according to claim 30, wherein the lubricity-enhancing additive is present in an amount of less than 1%, by weight, based on a total weight of the combined lubricity-enhancing additive and the carrier material.

38. A method of producing a composition comprising:

combining sulfuric acid and at least one reactant selected from the group consisting of:

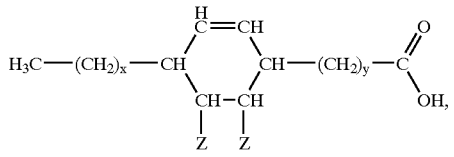

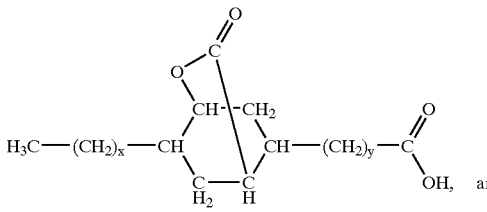

and

-continued

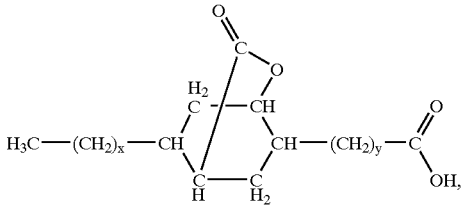

wherein x and y each independently represent an integer from 3 to 9, wherein x and y together equal 12, and Z represents a moiety selected from the group consisting of hydrogen and COOH, wherein at least one Z is hydrogen and one Z is COOH; and reacting the sulfuric acid and the at least one reactant to produce a product material.

39. A method according to claim 38, further comprising: reacting the product material with an inorganic base.

40. A method according to claim 39, wherein the inorganic base includes an alkali metal.

41. A method according to claim 39, wherein the inorganic base is selected from the group consisting of sodium hydroxide and potassium hydroxide.

42. A method according to claim 38, further comprising: reacting the product material with an amine.

43. A method according to claim 42, wherein the amine is an alkanolamine.

44. A method according to claim 42, wherein the amine is selected from the group consisting of triethanolamine, diglycolamine, and monoethanolamine.

* * * * *

UNITED STATES PATENT AND TRADEMARK OFFICE

CERTIFICATE OF CORRECTION

PATENT NO. : 6,699,822 B2
DATED : March 2, 2004
INVENTOR(S) : Phillip W. Hurd et al.

It is certified that error appears in the above-identified patent and that said Letters Patent is hereby corrected as shown below:

Title page,
Item [75], Inventors, please list as follows:
-- Phillip W. Hurd, Conyers, GA (US); Michael C. Bruner, Naperville, IL (US); Arnold Netzel, Chicago, IL (US) --

Column 1,
Line 66, please replace "contact" with -- contacted --.

Column 5,
Line 21, please replace "mixture" with -- mixtures --.
Line 47, please replace "staring" with -- starting --.

Column 6,
Line 60, please replace "inches" with -- instances --.

Column 12,
Line 31, please replace "alkanolanine" with -- alkanolamine --.

Column 15,
Line 13, please replace "represent" with -- represents --.

Signed and Sealed this

Ninth Day of November, 2004

JON W. DUDAS
*Director of the United States Patent and Trademark Office*